United States Patent [19]

Tsuzuki et al.

[11] Patent Number: 5,067,525

[45] Date of Patent: Nov. 26, 1991

[54] THREE-DIMENSIONAL FABRIC WOVEN BY INTERLACING THREADS WITH ROTOR DRIVEN CARRIERS

[75] Inventors: Makoto Tsuzuki; Masahiko Kimbara; Kenji Fukuta; Akihiko Machii, all of Tsukuba, Japan

[73] Assignee: Three-D Composites Research Corporation, Tsukuba, Japan

[21] Appl. No.: 458,400

[22] Filed: Dec. 28, 1989

[30] Foreign Application Priority Data

| | | | |
|---|---|---|---|
| Dec. 28, 1988 | [JP] | Japan | 63-335020 |
| Dec. 28, 1988 | [JP] | Japan | 63-335022 |
| Mar. 30, 1989 | [JP] | Japan | 1-79704 |
| Apr. 4, 1989 | [JP] | Japan | 1-85111 |

[51] Int. Cl.[5] ..... D04C 1/00

[52] U.S. Cl. ..... 139/11; 87/33

[58] Field of Search ..... 87/33, 37; 139/11

[56] References Cited

U.S. PATENT DOCUMENTS

| | | | |
|---|---|---|---|
| 4,312,261 | 1/1982 | Florentine | 87/33 |
| 4,615,256 | 10/1986 | Fukuta et al. | 139/11 X |
| 4,913,028 | 4/1990 | Yoshiya | 139/11 |

*Primary Examiner*—Andrew M. Falik

*Attorney, Agent, or Firm*—Oblon, Spivak, McClelland, Maier & Neustadt

[57] ABSTRACT

A three-dimensional fabric is woven by disposing a large number of contiguous rotors in columns and rows in an area in which carriers move about, with a carrier holding a thread being held between a pair of adjoining rotors. One of the paired rotors turns to move the carrier held between them while using the other rotor as a guide to help the transfer of the carrier. The carrier is caused to move along a predetermined path by repeating the above cycle.

10 Claims, 18 Drawing Sheets

THREE-DIMENSIONAL FABRIC WOVEN BY INTERLACING THREADS WITH ROTOR DRIVEN CARRIERS

FIELD OF THE INVENTION

This invention relates to methods and apparatuses for weaving three-dimensional fabrics.

DESCRIPTION OF THE PRIOR ART

Apparatuses for weaving three-dimensional fabrics by interlacing threads released from a plurality of bobbins supported by bobbin carriers that are adapted to move along predetermined paths are disclosed in the U.S. Pat. No. 4,312,261 and the Japanese Patent Publication No. 1538 of 1986.

The apparatus disclosed in the former has a number of carriers vertically and horizontally disposed in a box-like frame. Each of the carriers in the columns and rows is movable in the directions in which they are disposed. For example, a group of carriers in the desired column or row are moved in the direction in which they are disposed by one carrier distance before beating threads. A three-dimensional fabric is woven by repeating this cycle.

In this type of weaving apparatus, however, moving carriers produce much friction when they come in contact with each other. This has made it difficult to make larger weaving apparatuses with larger number of carriers. Besides, the bobbins that can be moved only by column or row have offered an obstacle to the weaving of more varied fabrics.

Because of the very complicated motions of bobbins, in addition, it has been difficult to grasp how their carriers should be driven and controlled without intricate computer-assisted simulation or other similar helps.

The weaving apparatus disclosed in the latter is free from the problem of contacting bobbin carriers because the carrier arms of bobbin carriers deliver one bobbin after another. But provision of the carrier arms that hold and deliver one bobbin after another calls for a complex mechanism involving means to open, close and rotate the carrier arms. This requirement has constituted an obstacle to size reduction and other improvement.

OBJECTS OF THE INVENTION

A primary object of this invention is to provide a larger weaving apparatus for weaving three-dimensional fabrics by interlacing threads held by bobbins or carriers that are adapted to move along predetermined paths in their moving planes that has a larger number of carriers, an ability to weave more varied fabrics and a simpler carrier holding and moving mechanism than before.

Another object of this invention is to provide a larger weaving apparatus having a simpler carrier holding and moving mechanism and an ability to weave more varied fabrics than before in which each carrier is held by a rotor on a number of drive units disposed in said moving plane so that only the desired carriers are independently moved by rotating the rotors holding them.

Still another object of this invention is to provide a weaving apparatus in which a mechanism to move the carriers is adapted to move along a spherical or cylindrical closed surface so that the threads led out from the carrier path to the weaving point of a three-dimensional fabric are always vertical or near-vertical.

In most apparatuses for weaving three-dimensional fabrics, including the conventional ones described before, the bobbin carriers are designed to move along a flat plane. When the weaving point is positioned above the center of the flat plane along which the carriers move, the threads from the bobbin carriers directly therebelow extend vertically to the plane. But the threads from the bobbin carriers apart from the middle ones extend diagonally. When the bobbin carriers move between such points, the threads become slack or tightly stretched, depending on the distance between the weaving point and each bobbin carrier. The tension working on threads varies with the position of the bobbin carrier. Where thread guides or other similar devices are used, excessively bent threads may become more susceptible to damage as a result of the friction with such guides etc.

The carrier moving mechanism of this invention that is adapted to move along a spherical or cylindrical closed surface, thereby ensuring that the threads from the carrier path always extend vertically or near-vertically to the weaving point, eliminates the aforementioned problems with the conventional apparatuses.

Yet another object of this invention is to provide a method and apparatus for weaving a wide variety of three-dimensional fabrics by simply turning two groups of rotors alternately through a desired angle. This facilitates grasping the moving path of bobbin carriers. Besides, bobbin carriers can be disposed according to the design of the three-dimensional fabric to be woven.

A further object of this invention is to provide a method and apparatus for weaving three-dimensional fabrics of uneven cross-sections. A fabrics having a continuously changing cross-section can be readily woven with the method and apparatus proposed above in which the independently controllable carriers can move relatively freely within the closed traveling surface.

SUMMARY OF THE INVENTION

In order to achieve the above objects, a large number of bobbin or thread carriers, essentially, are moved along desired paths within the limit of their travelling surface, with the threads held by the carriers interlaced into a three-dimensional fabric. Within the traveling surface, a large number of rotors, each of which is adapted to turn independently in both directions, are disposed one next to another. Each rotor has a plurality of recesses to hold a carrier between two adjoining rotors. The recesses are of such design that when one of the two adjoining rotors turns while holding a carrier, the recesses on the other rotor serve as a guide to assist in carrier transfer. Thus, the rotation of one of the two rotors holding a carrier therebetween moves the carrier forward, while the recesses on the other rotor serving as a guide for the moving carrier. When many rotors repeat this cycle in a predetermined sequence, many carriers move along a predetermined path to weave a fabric of the desired pattern.

An apparatus for weaving three-dimensional fabrics by interlacing threads held by a large number of bobbin or thread carriers adapted to move along a predetermined path in a given surface according to this invention has a device to drive the carriers as desired. This carrier driver comprises a large number of drive units that are designed to independently turn in both directions and disposed within the surface in which the carriers are designed to move. Each drive unit carries a rotor that is turned and driven within that surface. The rotors are disposed within that surface, one next to another. Each rotor has a plurality of recesses so that a carrier can be held between two adjoining rotors. The recesses are of such design that when one of the two adjoining rotors turns while holding a carrier, the recesses on the other rotor serve as a guide to assist in carrier transfer. The rotation of one of the two rotors holding a carrier therebetween moves the carrier forward, while the recesses on the other rotor serving as a guide for the moving carrier. When many rotors repeat this cycle in a predetermined sequence, many carriers move along a predetermined path to weave a fabric of the desired pattern.

DESCRIPTION OF THE PREFERRED EMBODIMENTS

The following paragraphs describe weaving methods and apparatuses according to this invention with reference to the accompanying drawings.

Figure 1:
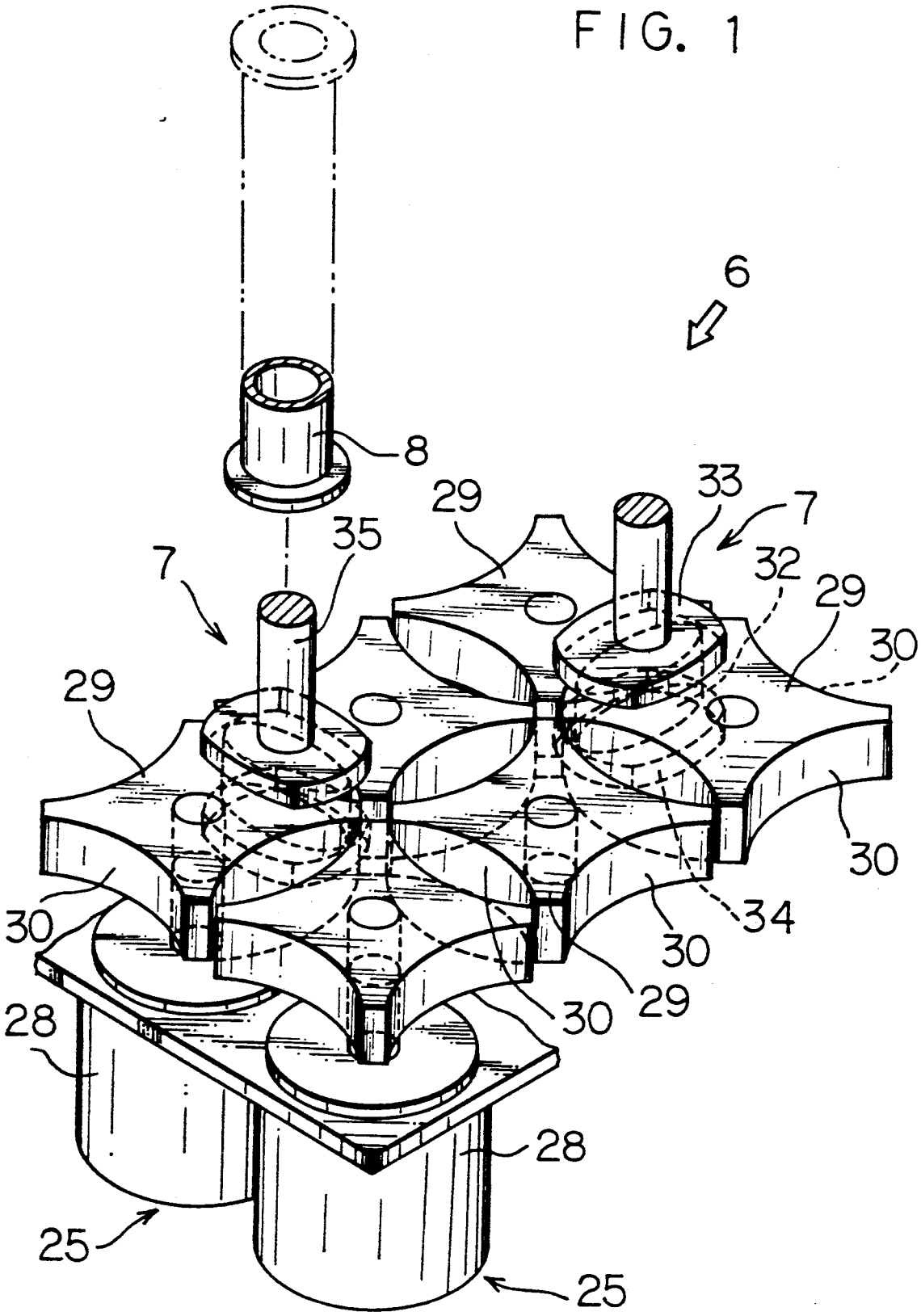
FIG. 1 is a perspective view showing the principal portion of a carrier driver in a three-dimensional fabric weaving apparatus according to this invention.
Figure 2:
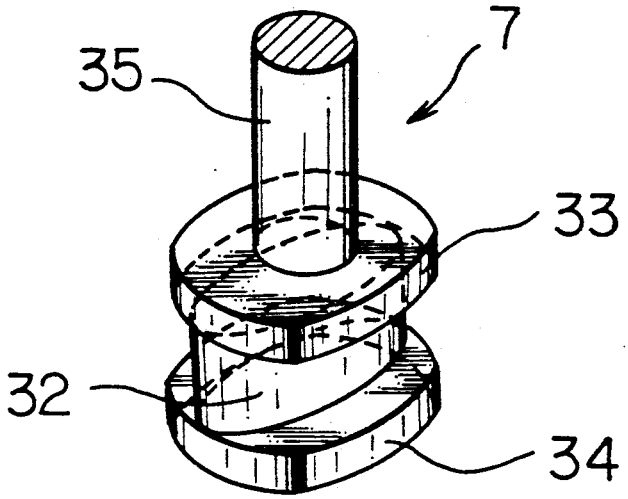
FIG. 2 is a perspective view of a carrier driven by the carrier driver.
Figure 3:
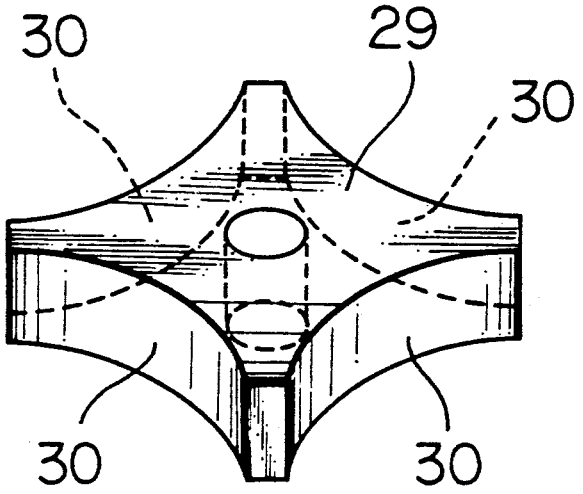
FIG. 3 is a perspective view of a rotor on a drive unit.
Figure 4:
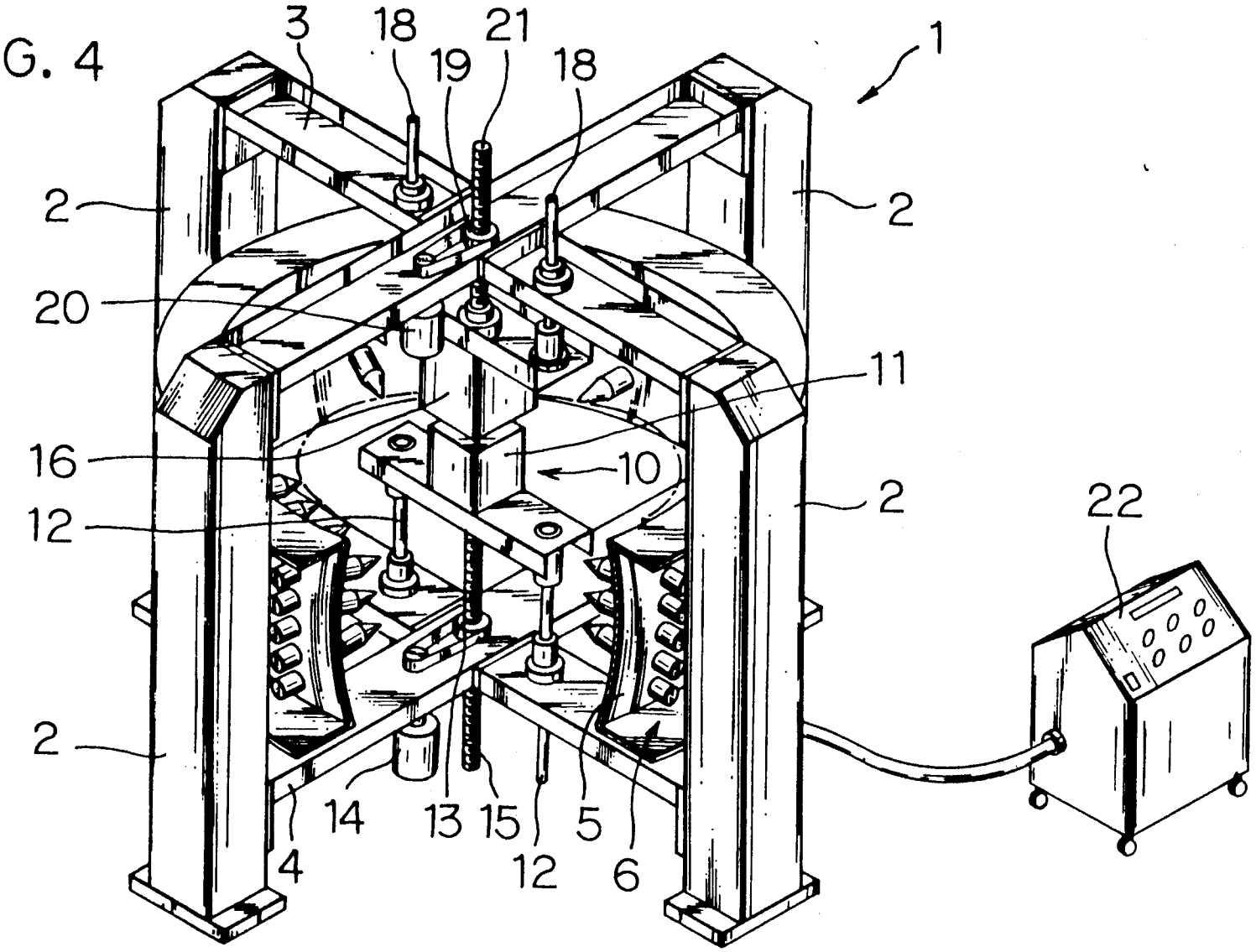
FIG. 4 is a partially broken perspective view of a three-dimensional fabric weaving apparatus embodying the principle of this invention.
Figure 5:
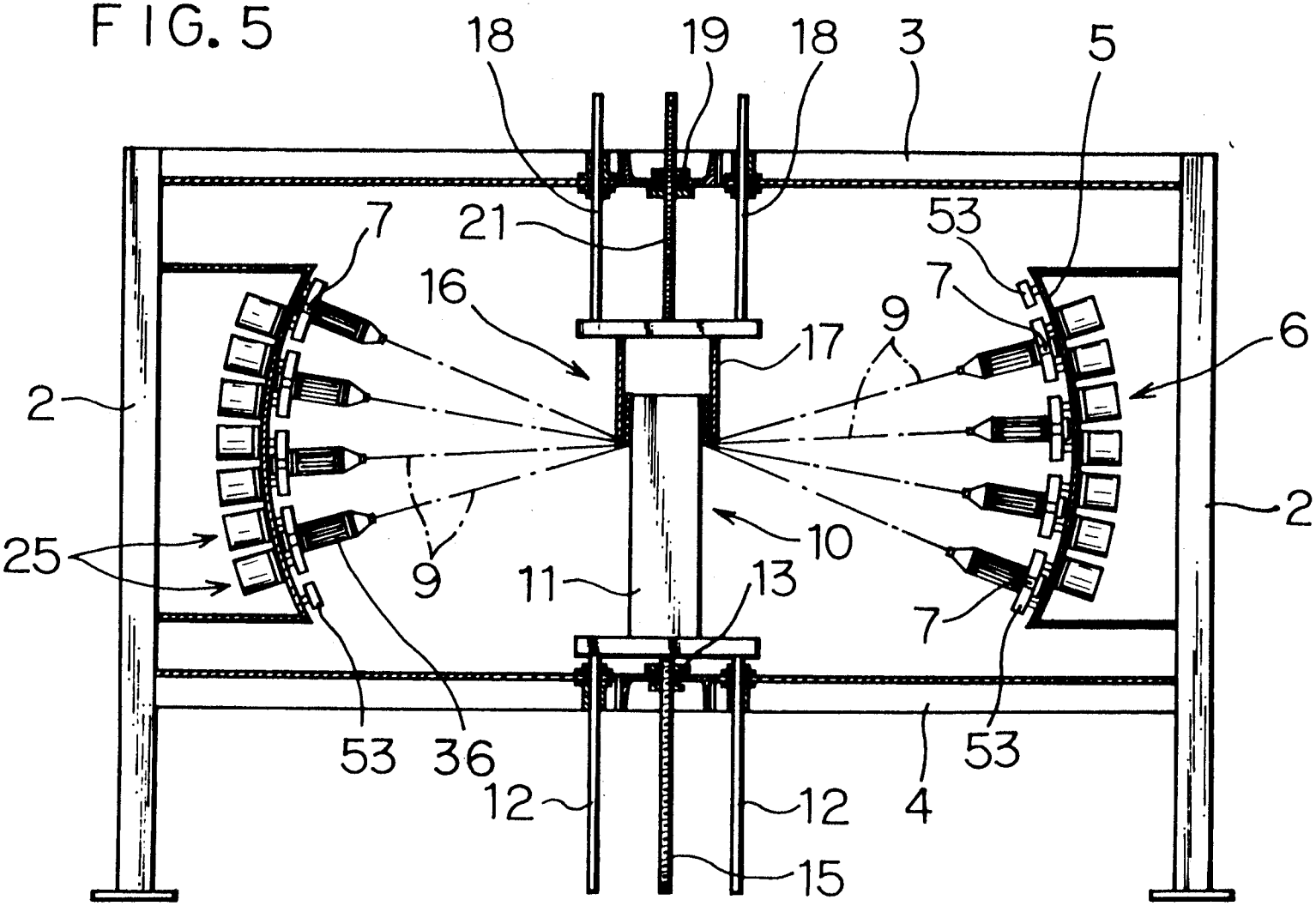
FIG. 5 is a cross-sectional side elevation of the same apparatus.

FIGS. 1 to 3 show a carrier driver and a drive unit that constitute a principal portion of this invention. FIGS. 4 and 5 show a three-dimensional fabric weaving apparatus equipped with the carrier driver.

The three-dimensional fabric weaving apparatus makes a three-dimensional fabric by moving bobbin carriers along predetermined paths and interlacing rovings released from a plurality of bobbins. The rovings described above mean bundled fibers drawn together filaments of glass fiber, carbon fiber or the like which are called glass roving, carbon roving or the like, though not only such rovings but also various kinds of threads can be used as well. In the preferred embodiment being described, the carriers support the bobbins. But the carriers may instead support the threads directly.

As shown in FIGS. 4 and 5, a frame 1 to support the whole weaving apparatus comprises columns 2 and a top frame 3 and a bottom frame 4 attached thereto. Support frames 5 to define the surfaces along which the carriers move are attached to the frame 1. A carrier driver 6 attached to each support frame 5 causes a carrier 7 to move along a carrier traveling surface that consists of a spherically curved closed surface. Therefore, the carrier traveling surface on the support frame 5 itself consists of a spherical surface intercepted at the top and bottom.

The frame 1 holds a weaving point setter 10 that provides a weaving point for a three-dimensional fabric positioned at the center of the carrier traveling surface by gathering the rovings 9 released from the bobbins 8 (FIG. 1) held by the carriers 7. Any suitable means capable of setting a weaving point at any desired point may be used as the weaving point setter 10. For example, a mandrel 11 forms a desired three-dimensional fabric by holding the leading ends of the rovings 9 from the bobbin 8 at the center of the carrier traveling surface and causing the threads to extend along the outer surface thereof, as illustrated.

The mandrel 11 is detachably mounted on a base plate so that mandrels of different designs can be used for three-dimensional fabrics of different patterns. As the mandrel 11 must be moved with the progress of weaving, guides 12 to guide the up-down motion thereof are attached to the bottom frame 4. A feed nut 13 rotated by a motor 14 is rotatably mounted on the bottom frame 4 so that the rotating feed nut 13 moves up and down a threaded rod 15 fitted through the base plate.

A regulator 16 to adjust the shape, thread pitch and density of a three-dimensional fabric, a beater (not shown) or the like may be provided as the weaving point setter 10, as well. The regulator 16 adapted to be changed according to the shape of the mandrel 11 consists of a hollow elevatable cloth-fell regulating frame 17 to accommodate the mandrel 11. The position of the cloth-fell regulating frame 17 changes with the progress of weaving. Guides 18 are attached to the top frame 3 to guide the up-down motion of the cloth-fell regulating frame 17. A feed nut 19 rotated by a motor 20 is rotatably mounted on the top frame 3 so that the rotating feed nut 19 moves up and down a threaded rod 21 fitted through the base plate.

A control unit 22 controls not only the action of the carrier driver 6 to move the drive units, which will be described in the following, but also the motion of the motors 14 and 20 to drive the mandrel 11 and cloth-fell regulating frame 17, the beater, and the like.

Referring now to FIGS. 1 to 3, a detailed description of the carrier driver 6 that causes the carriers to move as desired will be given.

The carrier driver 6 comprises a number of drive units 25 disposed along a spherical carrier traveling surface, as shown in FIG. 1. This arrangement defines the area in which the carriers 7 can move about. The drive units 25 may also be disposed along a cylindrical or flat surface, depending on the structure of the weaving apparatus and the shape of the three-dimensional fabric to be woven. For the sake of simplicity, FIG. 1 shows a flat carrier traveling surface.

Each of the drive units 25 making up the carrier driver 6 comprises a drive power supply 28 comprising a motor, speed-reduction gear, etc. that can be independently turned in both directions by means of the control unit (FIG. 4) and a rotor 29 (FIG. 3) that is rotated by the drive power supply.

The rotors 29 of the drive units 25 are adjoiningly disposed in columns and rows within the surface in which the carriers 7 are allowed to move about, as shown in FIG. 1. Each rotor 29 has four recesses 30 so that a pair of adjoining rotors can hold a carrier 7 therebetween. The recesses 30 are so designed that when one of the paired rotors 29 holding a carrier therebetween turns, the recesses 30 on the other rotor serve as a guide to assist in the transfer of the carrier 7. Accordingly, the inner surface of each recess 30 is either equal or functionally analogous to the surface of a cylinder described about the axis on which an adjoining rotor rotates.

The carrier 7 (see FIGS. 1 and 2) to be held between two rotors 29 comprises a grip 32 made up of such two cylindrical surfaces as are adapted to fit in the space formed between the recesses 30 of two adjoining rotors 29, upper and lower fastening flanges 33, 34, and a vertical support shaft 35 to carry a bobbin fitted thereon. As is obvious from the above description, the recesses 30 of two adjoining rotors 29 hold the grip 32 therebetween so that the carrier is moved to the desired direction by the rotation of one rotor 29. A device 36 to apply the desired tension (FIGS. 4 and 5) is attached to the bobbin 8 fitted on the support shaft 35 of the carrier 7, with a roving 9 to be woven taken out therethrough.

Figure 6:
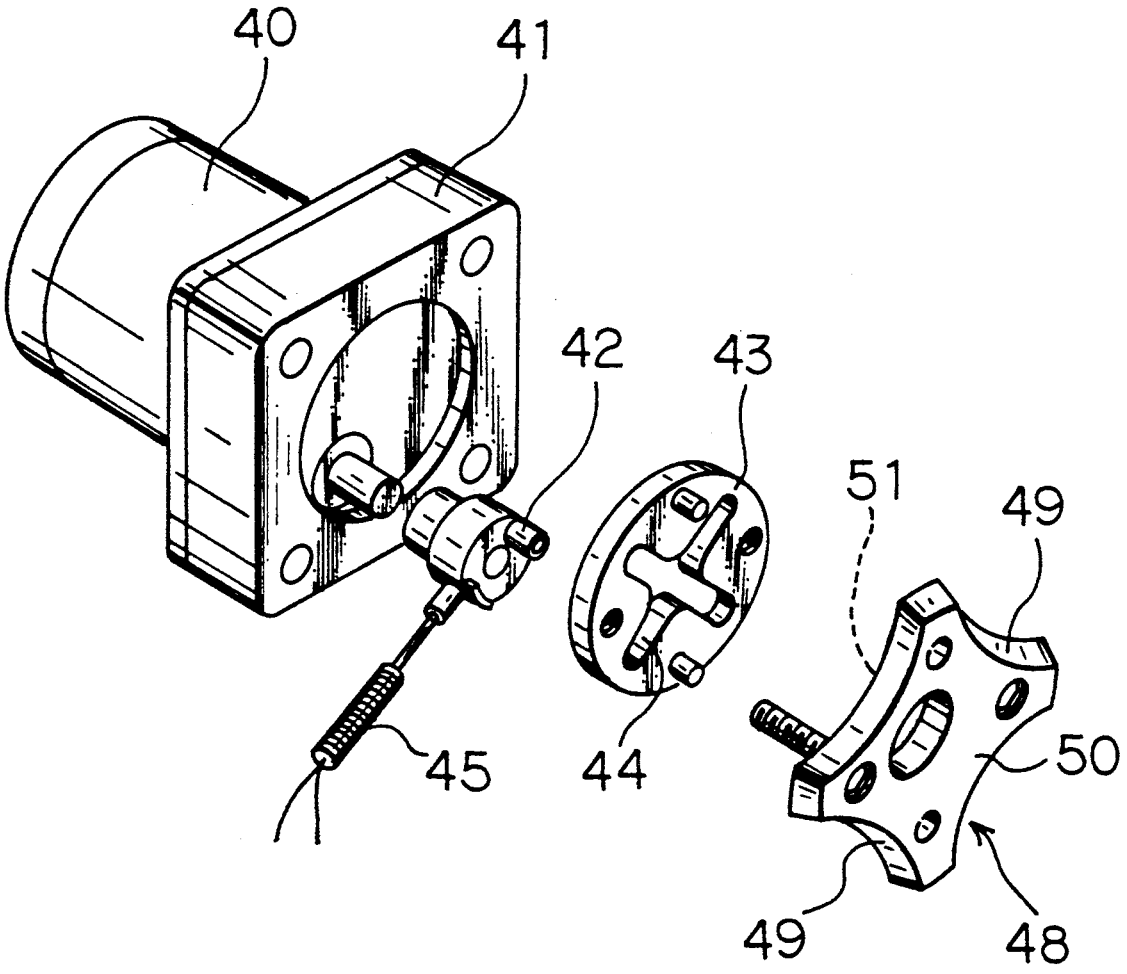
FIG. 6 is an exploded perspective view showing the principal portion of a drive mechanism in a drive unit.

Various types of driving means controllable by the control unit 22 can be used as the drive power supply 28 of the drive unit 25. FIG. 6 shows a drive mechanism that intermittently rotates a rotor 29 in both directions using an internal Geneva gear. With this type of drive mechanism, one rotation of a motor rotates the rotor through a desired angle.

The drive mechanism shown in FIG. 6 comprises a crank shaft 42 rotated by a motor 40 through a speed-reduction gear 51. The crank shaft 42 is disposed eccentrically to an internal Geneva gear 43 supported and rotated by the speed-reduction gear 41. The crank shaft 42 is inserted in a cam groove 44 in the internal Geneva gear 43. One rotation of the crank shaft 42 causes one quarter rotation of the rotor 29 attached to the internal Geneva gear 43. By changing the shape of the cam groove 44 according to the number of recesses 30 on the rotor 29, the angle through which one rotation of the crank shaft 42 turns the rotor 29 can be varied. In the figure, reference numeral 45 designates a sensor that detects the position of the rotating crank shaft 42.

Figure 7A:
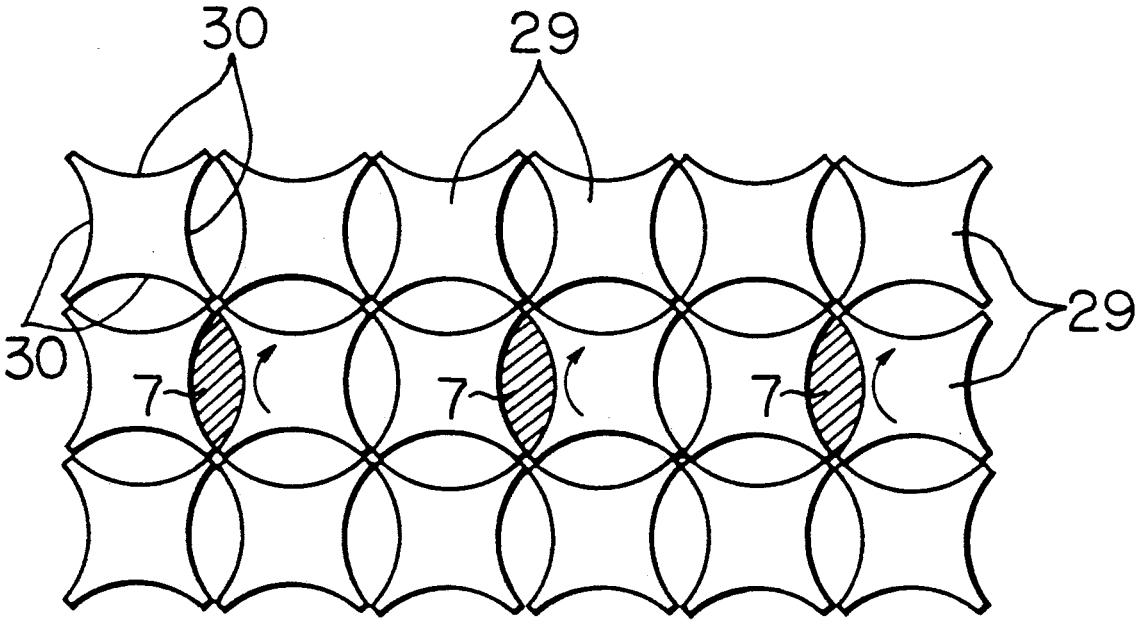
FIG. 7A and 7B illustrate how carriers move within the carrier traveling surface.
Figure 7B:
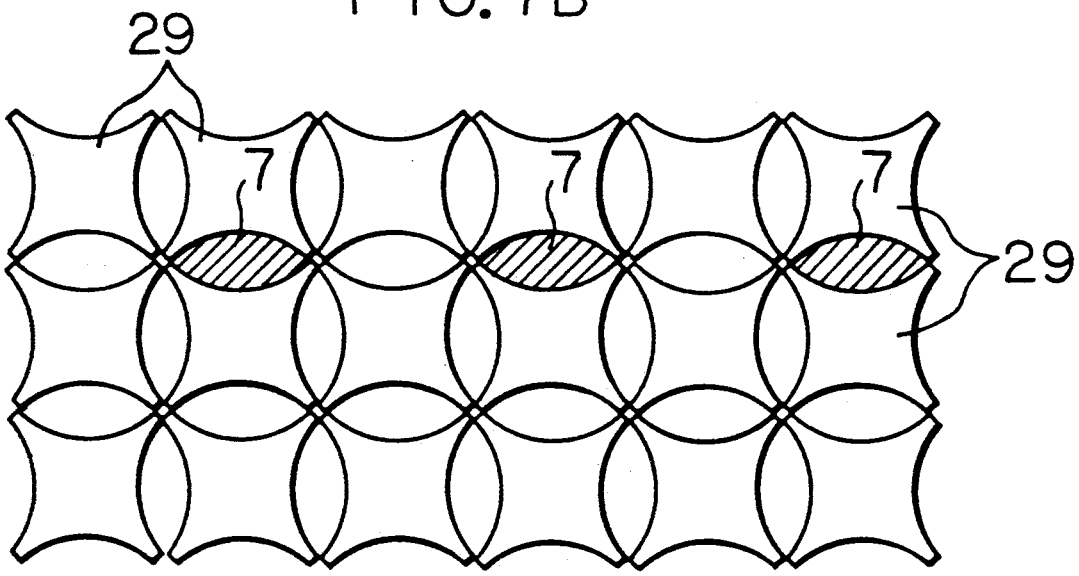
Figure 8A:
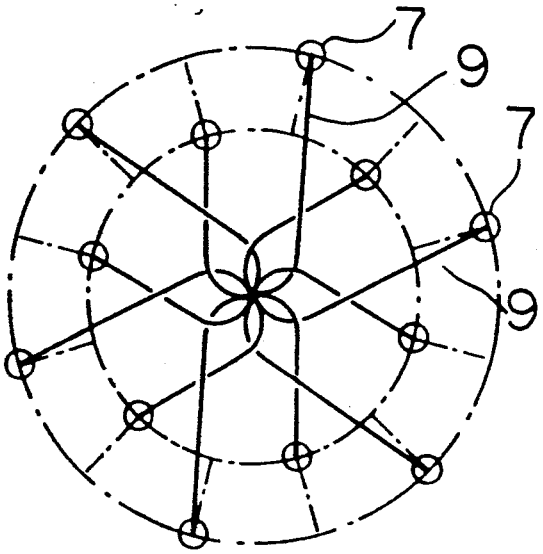
FIG. 8A to 8D sequentially illustrate how a three-dimensional fabric is woven on a weaving apparatus of this invention.
Figure 8B:
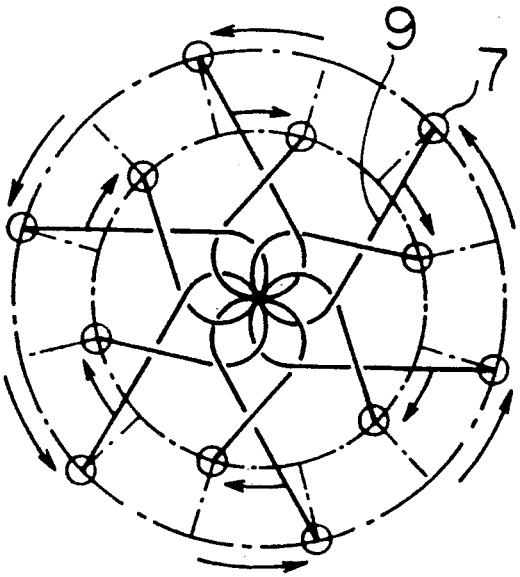
Figure 8C:
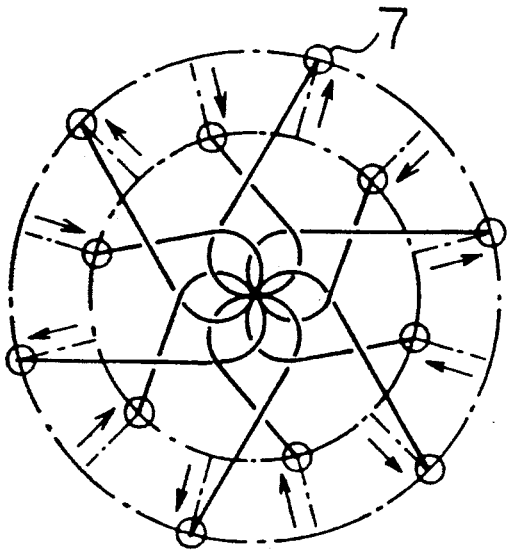
Figure 8D:
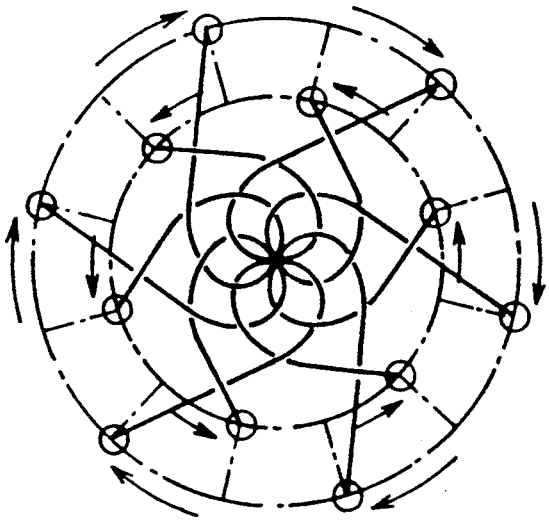

In a three-dimensional fabric weaving apparatus equipped with the carrier driver of the type just described, carriers 7 are held between pairs of rotors 29. When one of the paired rotors 29 turns, each carrier 7 moves, with the other rotor serving as a guide. FIG. 7A shows an example of a condition in which carriers 7 (indicated by hatching) are held between rotors 29 within the carrier traveling surface. FIG. 7B shows the position of the carriers 7 when the rotors 29 are turned through 90 degrees in the direction indicated by arrows. By repeating the movement like this, a large number of carriers 7 are moved in either of the two directions. The carriers 7 then move along a predetermined path, thereby interlacing the rovings 9 released from the bobbins held thereby along the mandrel 11 to produce a three-dimensional fabric conforming to the profile of the mandrel 11.

Any desired number of the carriers 7, each of which is adapted to be independently moved by drive units 25 and by rotors 29 having recessions 30 of the shape described before, can be readily moved in any desired direction. This feature permits increasing the variety of fabric patterns and the size of weaving apparatuses. Besides, the drive unit that can move the carrier to any desired position by itself drastically simplifies the carrier holding and transferring mechanism.

In the weaving apparatus just described, the carriers 7 are adapted to move along a spherical closed surface, with the weaving point of a three-dimensional fabric positioned near the center thereof. Therefore, the threads 9 from the carriers 7 moving along a predetermined path always extend vertically or near-vertically from the carrier traveling surface to the weaving point. Thus, no significant deviation arises between the bobbins 8 held the moving carriers 7 and the weaving point.

The carrier traveling surface of the weaving apparatus is not limited to a spherical surface. A cylindrical closed surface serves the purpose, too. With a cylindrical closed surface, however, it is preferable to adjust the vertical position of the carrier traveling surface and the weaving point setter 10 relative to each other so that the threads extending from the cylindrical closed carrier traveling surface to the weaving point are disposed as vertically as possible.

In the illustrated preferred embodiment, the rotors 29 are disposed in columns and rows, with provisions made to turn those rotors 29 which hold carriers 7 90 degrees each. But the arrangement of the rotors 29 is not limited to the illustrated one. For example, six recesses 30 may be provided around a rotor 29 at equal intervals, whereby each rotor adapted to turn 60 degrees each is surrounded by six adjoining rotors. As such, the number of recesses and the angle through which each rotor turns can be chosen as desired.

When a number of drive units 25 are disposed along a cylindrical or spherical carrier traveling surface to form a carrier driver 6 as mentioned before, it sometimes becomes necessary to use some consideration in conforming the shape of the concave recesses 30 on the rotor 29 or that of the grip 32 of the carrier 7 to the profile of the cylindrical or spherical carrier traveling surface.

When the carrier traveling surface is cylindrical, for example, the shape of the concave recesses 30 on the rotor 29 or that of the grip 32 of the carrier 7 must be changed according to differences in the curvature of the carrier traveling surface depending on whether the carrier 7 is held between rotors 29 adjoining in the circumferential direction (with the axes of the adjoining rotors unparalleled) or between rotors 29 adjoining in the direction of the generators of a cylinder (with the axes of the adjoining rotors paralleled). Otherwise, the carrier 7 cannot be held in an accurate position.

No special consideration is required when the diameter of a cylindrical surface forming the carrier traveling surface is large enough to permit regarding the carrier traveling surface as a substantially flat surface. Even when some such considerable is required, provision of an elastically deformable member to the concave surface 30 of the rotor or the surface of the grip 32 of the carrier or other similar simple means serve the purpose.

FIG. 6 exaggerates the profile of a rotor 48 used with a spherical carrier traveling surface. Each recess 49 on the rotor 48 is shaped like a cone whose surface converges to the center of the spherical carrier traveling surface. The surface 50 facing the center of the spherical carrier traveling surface and the opposite surface 51 are made into a spherical surface concentric to the carrier traveling surface. Furthermore, the grip 32 of the carrier 7, too must be shaped like a cone whose surface converges to the center of the spherical carrier traveling surface. An equal number of rotors 48 are disposed in the individual rows parallel to the equatorial plane, with the diameter of the rotors decreased in proportion to a decrease in the diameter of the cone as the distance from the equatorial plane increases. This design permits securing the preset appropriate clearance irrespective of the position of the moving carrier. But the rotors should not be provided too far away from the equatorial plane.

It is necessary to provide idle rotors or stationary guides 53 (FIG. 5) having recesses similar to those on the rotors on the outside of the carrier traveling area formed by disposing many rotors along the carrier traveling surface.

FIGS. 8A to 8D sequentially show the steps by which a fabric is woven by the weaving apparatus just described. For the sake of simplicity, a cylindrical or spherical carrier traveling surface is exploded, with the woofs and warps thereon indicating radial and concentric lines. The circles in the figure show the carriers 7 and the arrows indicate the directions in which the carriers 7 have just moved. The fabric shown in FIGS. 8A–D is woven by use of only two groups of thread 9 with one group being turned to the left and the other to the right. Consequently, the term warps and woofs are arbitrary in this context.

Figure 13:
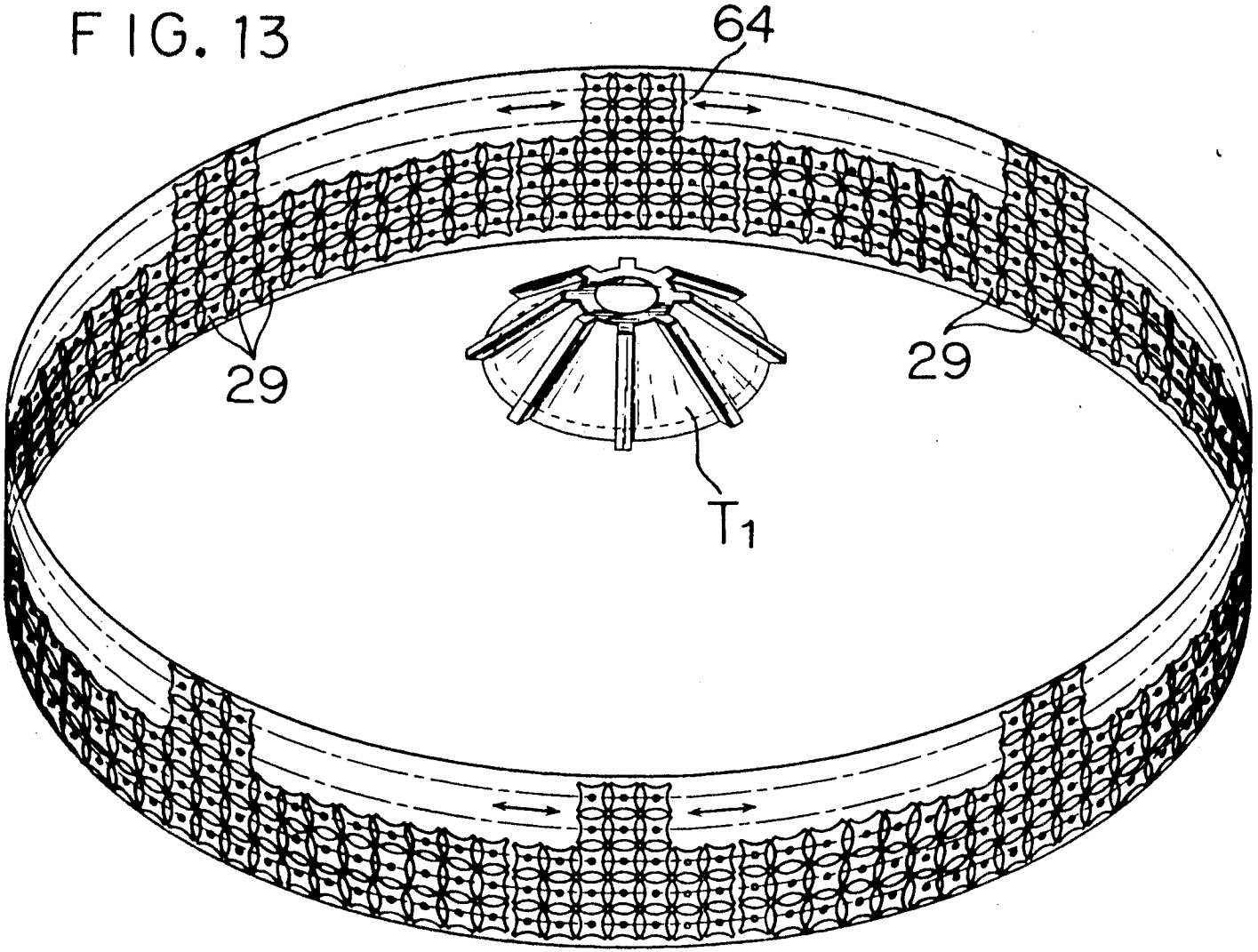
FIG. 13 schematically illustrates how a three-dimensional fabric of a deformed cross-section is woven.

FIGS. 8A–D show the cylindrical or spherical carrier traveling surface (which is also shown in FIG. 13 or FIGS. 4 and 5 viewed from above). These are exploded to show the upper side of the traveling surface on the outside thereby schematically showing the carriers in their paths in the weaving process in a highly simplified manner. The fabric becomes three-dimensional as the carriers move along a concentric path. This occurs in that the threads are held by means of the bobbin 8 such as is shown in FIG. 1 around which they are wound. The device 36 of a conventional type of apparatus applies the desired tension to the thread which are led out through the tip of the conical cover of the device 36 as shown in FIGS. 4 and 5. This mechanism is substantially analogous to that employed in prior art and consequently will not be discussed in any more detail here.

The spherical closed surface means the surface on which the carrier moves around is as shown in FIGS. 4 and 5. The surface is closed around its periphery in contrast to the open surface such as is shown in FIGS. 14–17. As is obvious from FIGS. 4 and 5, the surface resembles that of a sphere which has its opposite ends removed.

The weaving point setter 10 comprising the mandrel 11 controls the shape of the fabric to be woven in the desired pattern in conjunction with the cloth-fell regulating frame 17. The shape control is achieved when, for example, the carriers move around the mandrel 11 as shown in FIGS. 8A–D whereby the threads 9 are wound around the mandrel 11. Consequently, the cloth-fell regulating frame 17 controls the weaving point in the direction of the axis of the mandrel 11. This provides a three-dimensional fabric of the desired shape being obtained.

Figure 9:
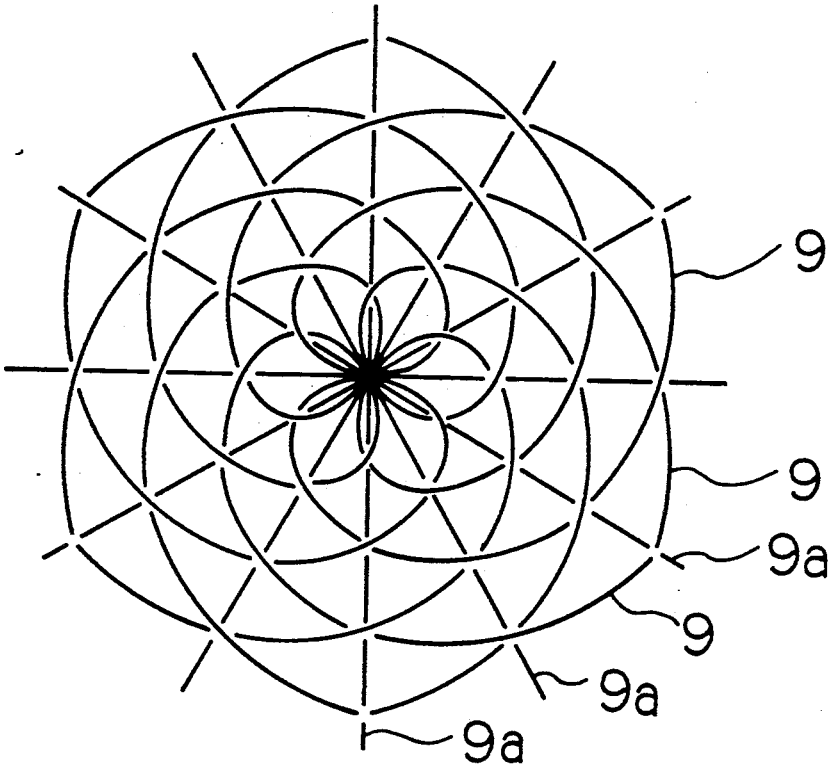
FIG. 9 shows a fabric woven by adding radial threads to the three-dimensional fabric shown in FIG. 8.

FIG. 9 shows a fabric made by adding radial threads 9*a* to the one shown in FIG. 8.

Figure 10:
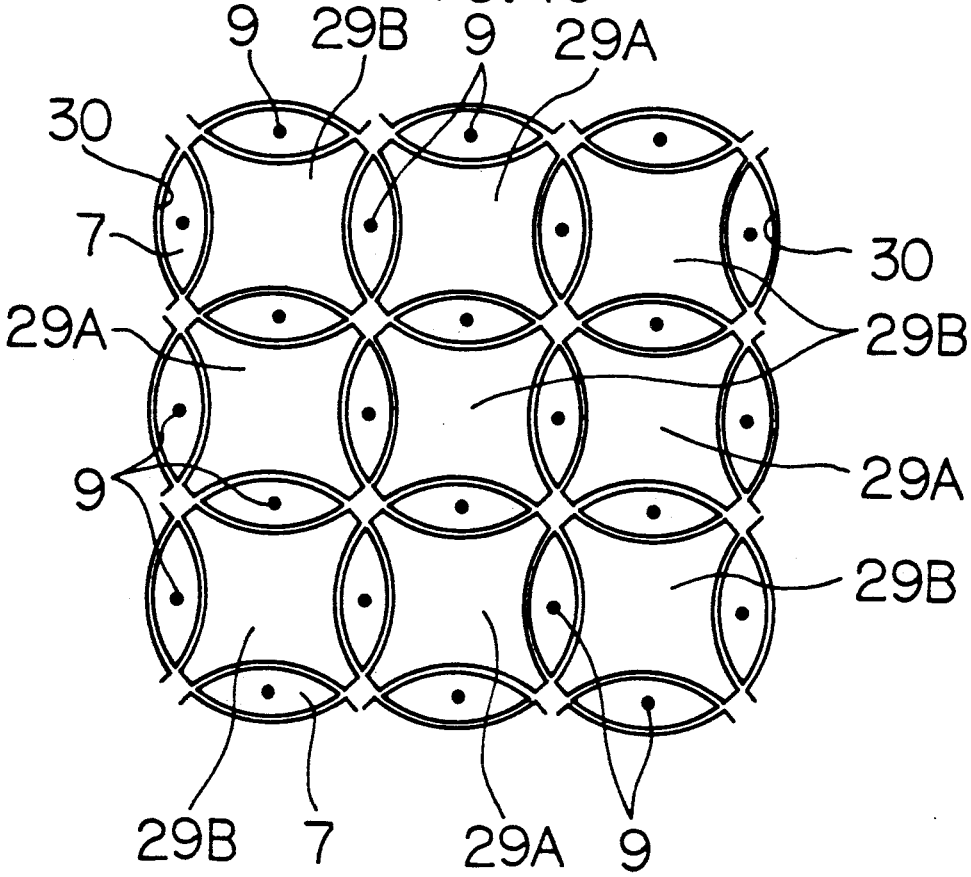
FIG. 10 shows the rotors divided into two groups.

In FIG. 10, the rotors 29, each of which has four recesses 30 therearound, that do not adjoin in the individuual columns and rows are divided into two groups of rotors 29A . . . and 29B . . . It is much simpler to drive the whole rotors in each group at a time. The paths of the moving carriers can be grasped with ease, too. In addition, the grouped actuation of the rotors facilitates weaving three-dimensional fabrics of various profiles.

Means for driving the rotors in the two groups must intermittently turn the rotors of each group 90 degrees or 180 degrees in the same direction. Besides, the rotors in the two groups must be turned at least in opposite directions. In FIG. 10, reference numeral 29A designates the rotors that are intermittently turned 90 degrees or 180 degrees clockwise (hereinafter called the rotors of a first group). Reference numeral 29B designates the rotors that are intermittently turned 90 degrees or 180 degrees counterclockwise (hereinafter called the rotors of a second group).

Figure 11A:
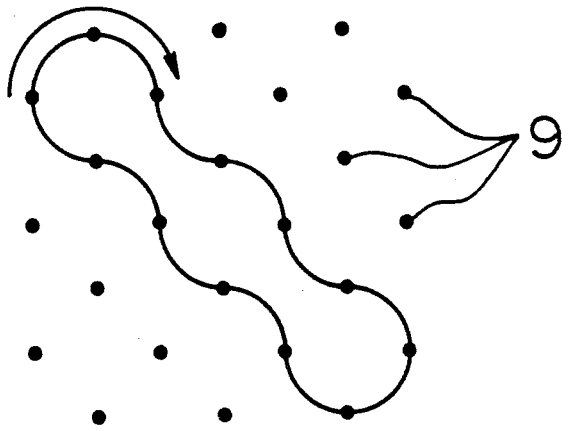
FIGS. 11A to 11C show the sequence of a weaving motion in which the two groups of rotors shown in FIG. 10 are alternately turned through 90 degrees.
Figure 11B:
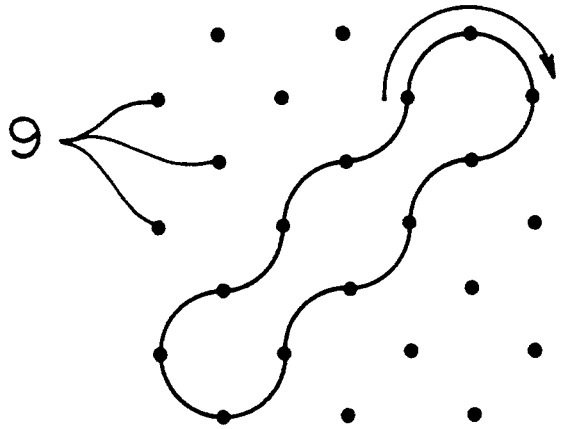
Figure 11C:
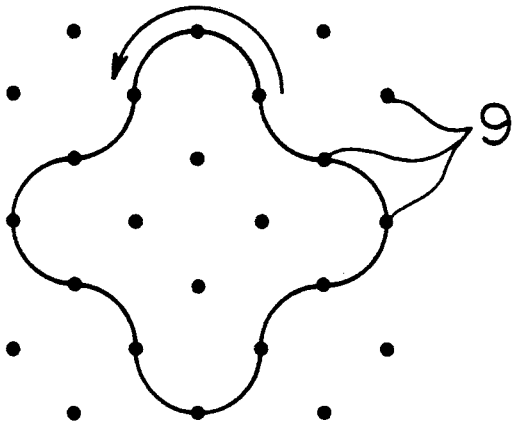
Figure 12A:
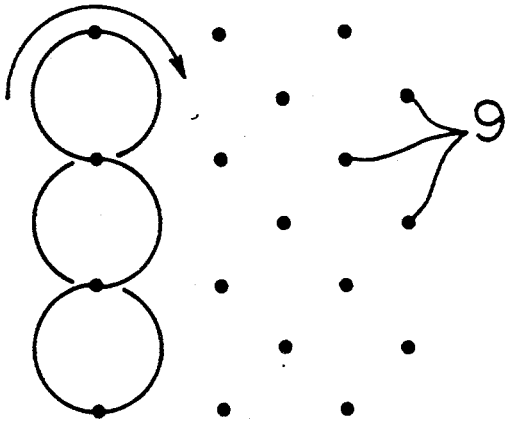
FIG. 12A to 12F show the sequence of a weaving motion in which the two groups of rotors are alternately turned through 180 degrees.
Figure 12B:
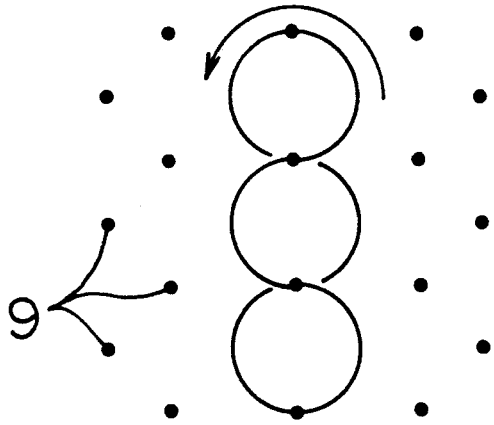
Figure 12C:
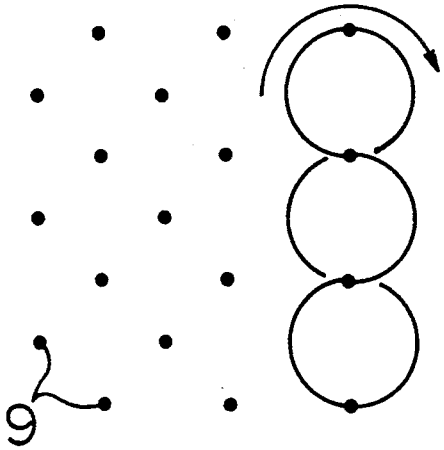
Figure 12D:
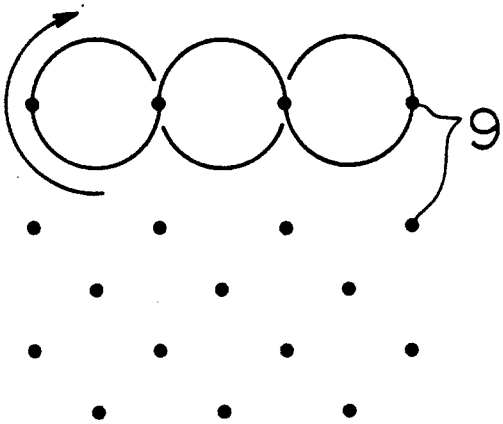
Figure 12E:
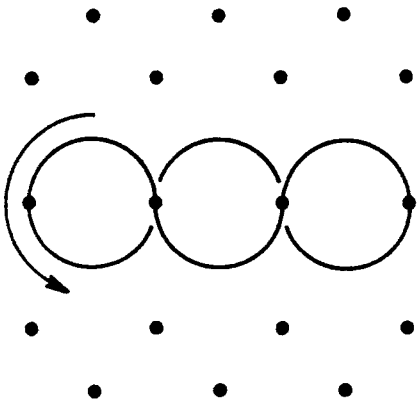
Figure 12F:
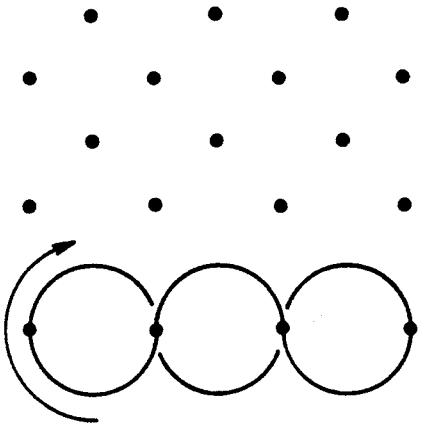

FIGS. 11A to 11C show how weaving with the rotor arrangement shown in FIG. 10 proceeds. Namely, FIGS. 11A to 11C show the moving paths of the rovings 9 when the rotors of the first and second groups are alternately turned 90 degrees while the adjoining rotors holding carriers 7 therebetween. The rovings 9 on the curves shown in FIG. 11 move along the curves while forming a closed loop as the rotors turn progressively, eventually forming a fabric in which the individual motions of the threads are combined. FIGS. 12A to 12F show the paths of the threads 9 described when the rotors of the first and second groups are individually turned 180 degrees.

Whether the rotors are turned 90 degrees or 180 degrees, the rovings 9 apparently move within the area in which the carriers are disposed according to a relatively simple rule. Therefore, any desired three-dimensional fabric can be made according to a randomly chosen arrangement of the carriers. Besides, the structure, especially the orientation of the fabrics along four axes, of each fabric can be readily changed by simply changing the angle through which the rotors of each group are turned.

Three-dimensional fabrics with five axes can be readily woven by passing stationary threads (core threads) through a hole provided at the center of each rotor. The three-dimensional fabrics with five axes dimensionally very stable.

Figure 14:
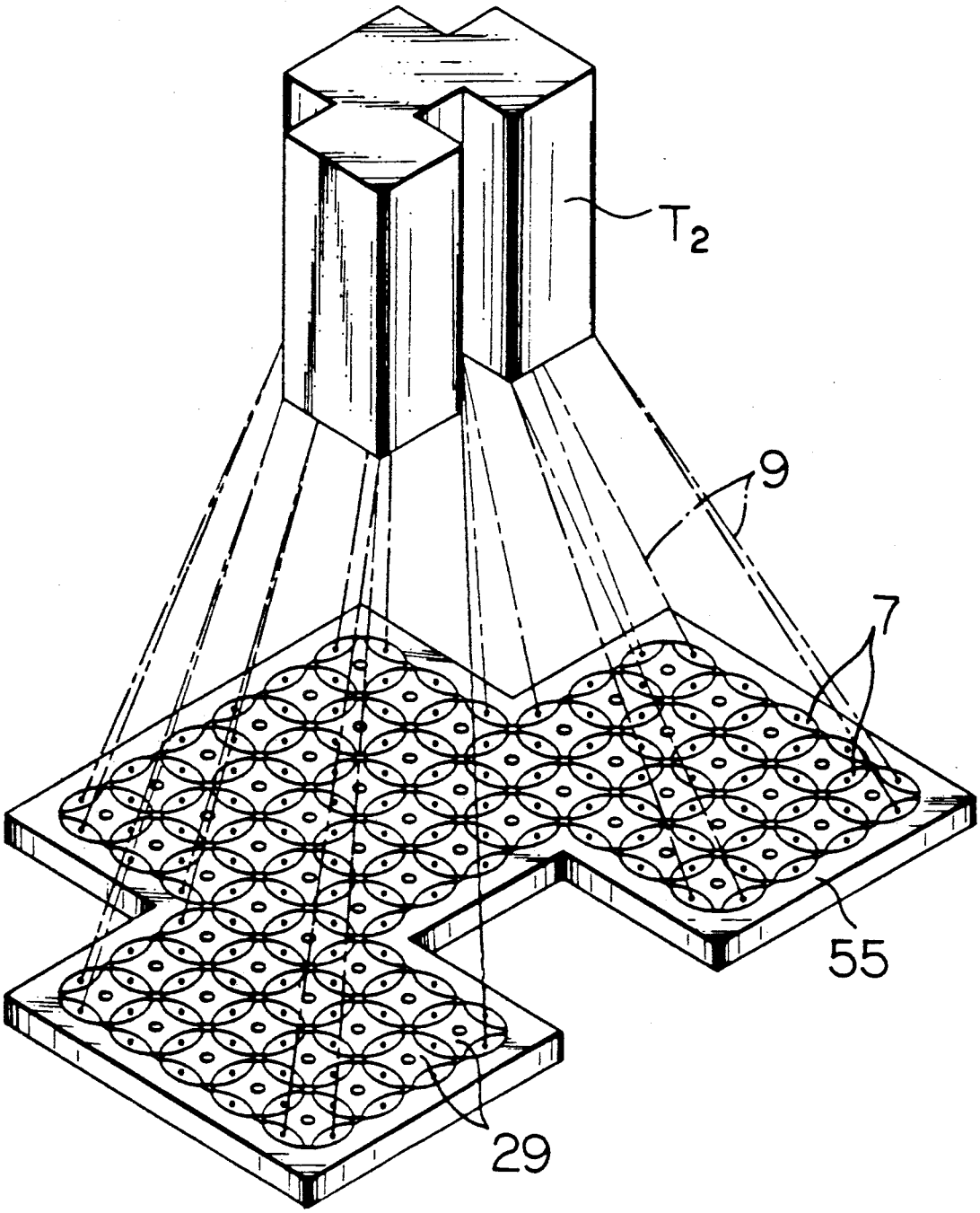
FIG. 14 is a perspective view showing a weaving action carried out within a limited carrier moving area.

FIGS. 13 and 14 show how three-dimensional fabrics $T_1$ and $T_2$ of deformed cross sections are woven. As shown in FIG. 13, a large number of adjoining rotors 29 are disposed in columns and rows throughout the entirety of a cylindrical carrier traveling area. It is only the rotors to be engaged in weaving that are driven and hold carriers (not shown) therebetween. This arrangement results in a three-dimensional fabric $T_1$ of a design shown in FIG. 13. FIG. 13 shows only the rotors that are engaged in weaving, with other rotors omitted. The rotors surrounding the rotors engaged in weaving may be used as an idle stationary guide.

FIG. 14 shows an embodiment in which the carriers 7 move over a flat plane. A flat deformed carrier traveling area is preset according to the desired profile of a three-dimensional fabric to be woven. The periphery of the carrier traveling area is surrounded by a stationary guide 66, and a number of adjoining rotors 29, arranged in columns and rows, are disposed therein. This arrangement results in a three-dimensional fabric $T_2$ of a profile shown in the same figure.

In either of the embodiments shown in FIGS. 13 and 14, it is appropriate to turn the rotors of a first groups 90 degrees or 180 degrees in one direction while using the rotors of a second group as an idle stationary guide and, then turn the rotors of the second group 90 degrees or 180 degrees in the opposite direction while using the rotors of the first group as an idle stationary guide. The desired three-dimensional fabric is obtained by repeating this cycle.

Any desired three-dimensional fabric can be easily woven by a simply turning the rotors of the two groups 90 degrees or 180 degrees and disposing carriers according to the profile of the fabric to be woven.

Figure 15:
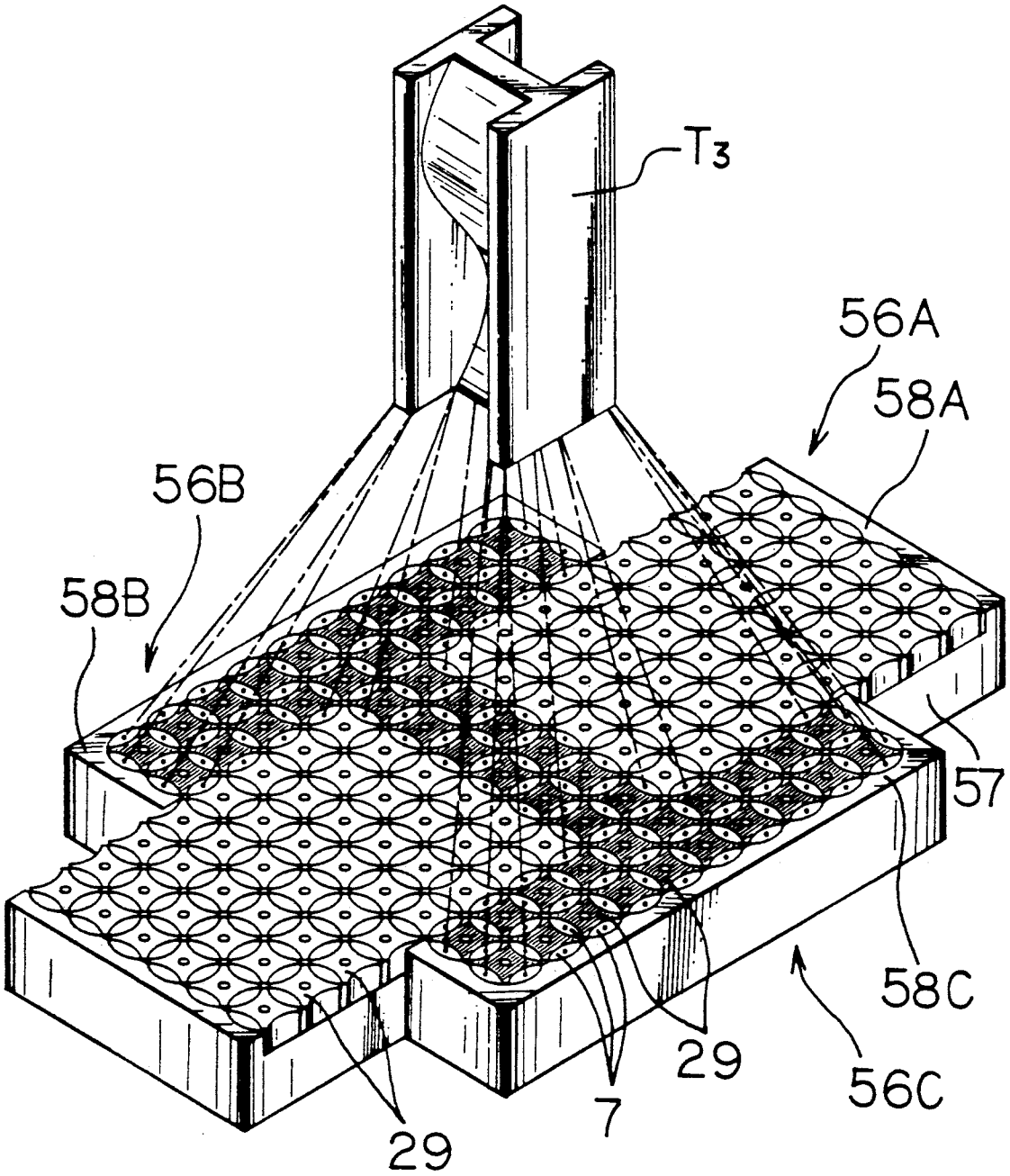
FIG. 15 is a perspective view of an apparatus for weaving three-dimensional fabrics of uneven cross-sections.
Figure 16A:
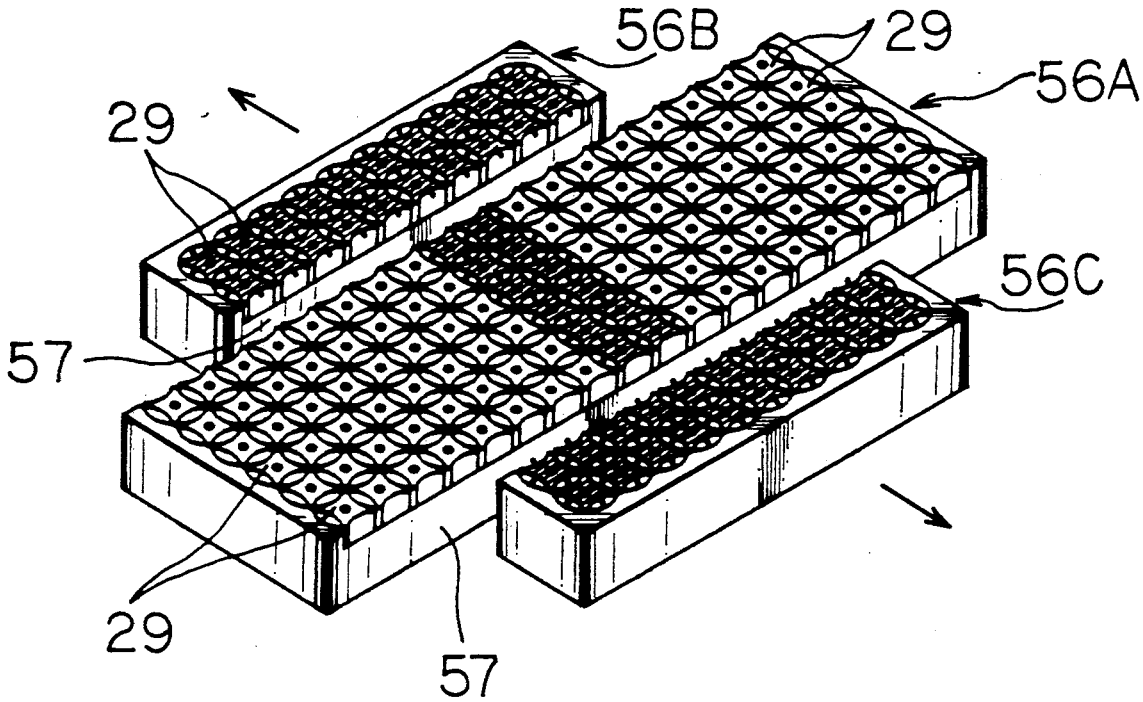
FIGS. 16A and 16B sequentially illustrate how a three-dimensional fabric of an uneven cross-section is woven.
Figure 16B:
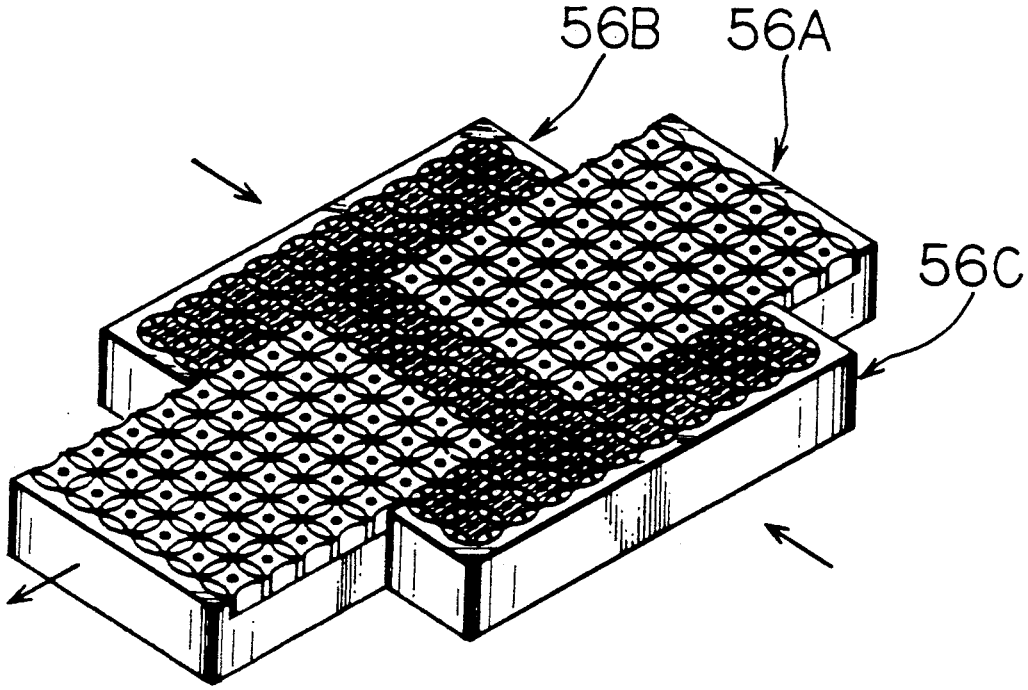

FIG. 15 shows an apparatus for weaving a three-dimensional fabric $T_3$ with an unevenly shaped cross section as shown therein. FIGS. 16A and 16B show the processes of weaving. The weaving apparatus shown in FIG. 15 has weaving blocks 56A to 56C, each of which has a flat carrier traveling area, with a number of drive units disposed therealong. The rotors 29 in the drive units cause the carriers to move along predetermined paths to interlace the rovings 9 carried thereby.

In FIG. 15 and other following figures, the rotors 29 engaged in weaving are distinguished from the rest by hatching. Also, a combination of two adjoining rotors 29 and a carrier 7 held therebetween is indicated by a dot given at the center of the carrier 7 to show the point from which a thread is drawn out.

The weaving blocks 56A to 56C are surrounded by guides 58A to 58C to fasten the carriers 7 in position, except on the edges adjoining other weaving blocks. The stationary guides 58A to 58C are formed by providing a number of recesses, which are similar to the recess 30 on the rotor 29, on the inner side of the peripheral walls of the individual weaving blocks. The adjoining blocks are joined together by arranging the rotors 29 thereof along the contiguous edges 57 in such a manner as to hold carriers 7 therebetween.

Carriers 7 can be placed between all the rotors 29 disposed in rows and columns and between the rotors 29 and stationary guides 58A to 58C in the weaving blocks 56A to 56C. Or only as many carriers 7 as are required for weaving may be placed between a limited number of rotors 29. In the latter case, the carriers 7 are not spread out across the weaving blocks, but placed close to one another in a limited space, thereby defining a weaving area. To connect the weaving areas in two adjoining weaving blocks, carriers 7 are either placed between the adjoining rotors 29 lying along the contiguous edges of the adjoining weaving blocks or passed therethrough in the course of the weaving operation.

For weaving a three-dimensional fabric, carriers 7 are placed between the rotors 29 to be engaged in the individual weaving blocks 56A to 56C. The weaving ares formed in the weaving blocks 56A to 56C by disposing the required carriers 7 are joined together to form a larger single weaving area. Thus, the carriers 7 can now freely move from one weaving block to another in that larger weaving area as required by each weaving operation.

The appropriately turned rotors 29 cause the carriers 7 held thereby to move along the paths chosen for the execution of the desired weaving. As described previously by reference to FIGS. 10 to 12, all rotors in the weaving area may be divided into two groups. The rotors 29 in one group are first turned 90 degrees or 180 degrees in one direction. Then, the rotors 29 in the other group are turned through the same angle in the opposite direction. The motion of the rotors can be controlled with relative ease by repeating this cycle. This type of operation causes the carriers 7 to move from one to another of the adjoining weaving blocks 56A to 56C, thereby performing an integrated weaving operation throughout the blocks.

A three-dimensional fabric having an uneven cross-section is made by successively shifting the joints between the adjoining weaving blocks in the course of weaving, as illustrated in FIGS. 16A and 16B. To shift the position of the weaving blocks 56B and 56C with respect to the weaving block 56A, the weaving blocks 56B and 56C, which have been joined to the weaving block 56A as shown in FIG. 15, are temporarily detached from the weaving block 56A as indicated by arrows in FIG. 16A. After moving the weaving block 56A to the desired position, the weaving blocks 56B and 56C are re-joined thereto, thereby accomplishing the desired shifting, as indicated by arrows in FIG. 16B. Some appropriate temporary holding means may be used if there is a likelihood of the carriers falling from the contiguous edges 57 when the weaving blocks 56B and 56C are detached from the weaving block 56A. But no such temporary holding means are required when carriers are not filled between all rotors. Then, the weaving blocks may be detached when there is no carriers along the contiguous edges. Even if there are some carriers along the contiguous edges, such carriers may temporarily be moved to other secure place.

The shifting of the weaving blocks is possible because the weaving mechanism of this invention is essentially designed to permit changing weaving patterns.

Shifting the joints of the weaving blocks permits varying the cross section of a three-dimensional fabric, as in a three-dimensional fabric $T_3$ shown in FIG. 15.

Figure 17:
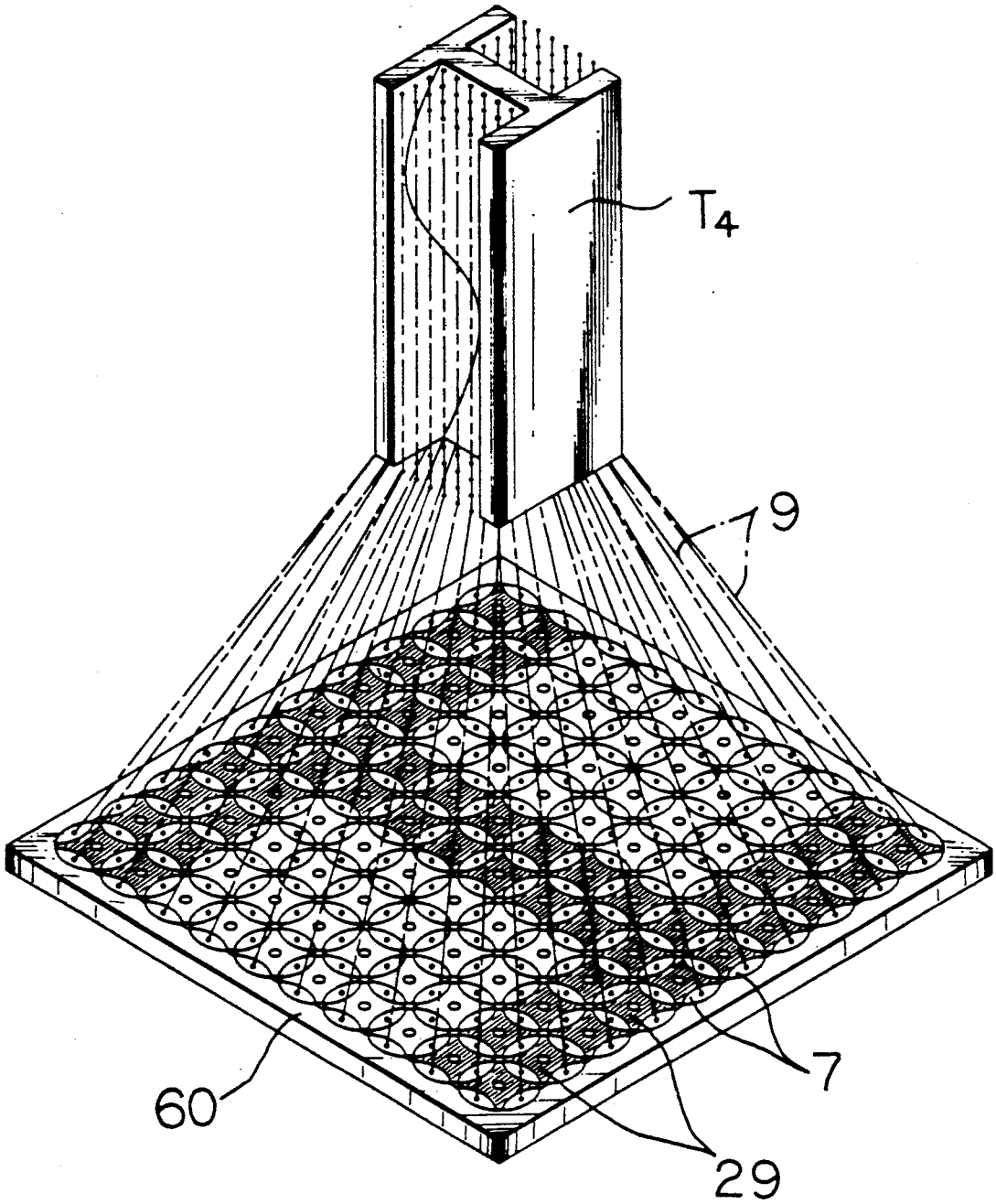
FIG. 17 is a perspective view of another apparatus for weaving three-dimensional fabrics of uneven cross-sections.

FIG. 17 schematically shows a second apparatus of this invention for weaving a three-dimensional fabric $T_4$ with an uneven cross section.

This weaving apparatus comprises rotors 29 that are disposed in columns and rows over a single carrier traveling surface. Carriers 7 driven thereby move along predetermined paths to weave a three-dimensional fabric $T_4$. The carriers 7 are placed between all rotors 29 and the rotors and a surrounding stationary guide 60. But this arrangement is not always necessary. Instead, carriers 7 may be dispersed according to the structure of the three-dimensional fabric to be woven. But carriers 7 must be disposed substantially evenly throughout the entire carrier traveling area, with the carriers 7 engaged and not engaged in weaving equally held between rotors 29.

In weaving the three-dimensional fabric $T_4$, only the rotors 29 hatched in FIG. 17 are driven to perform the desired weaving action. The rotors not engaged in weaving are not driven and, therefore, serve as a stationary guide surrounding the rotors in action.

Here again, the motion of the rotors can be controlled with relative ease by dividing the rotors in the weaving area into two groups, turning the rotors 29 in one group 90 degrees or 180 degrees in one direction, and then turning the rotors 29 in the other group through the same angle in the opposite direction.

Thus, a three-dimensional fabric is woven according to the arrangement of the driving rotors 29. The three-dimensional fabric $T_4$ with an uneven cross section can be produced by successively changing the cross-sectional shape of the fabric. This change can be achieved by successively changing the driving rotors and moving the weaving area from one place to another.

The weaving area can be moved around by simply actuating the rotors in a new weaving area to perform the desired weaving action, while stopping the rotors in the area where the desired weaving action has been completed. By thus moving the weaving area, the cross-sectional shape of a three-dimensional fabric can be changed successively. $T_4$ is an example of a three-dimensional fabric with an uneven cross section resulting from this type of operation.

In this method, it is necessary to remove the threads not used in weaving from the finished three-dimensional fabric $T_4$ on completion of weaving.

FIGS. 18 and 19A to 19D show an apparatus and steps of weaving a three-dimensional fabric $T_5$ with an uneven cross section according to this invention.

Figure 18:
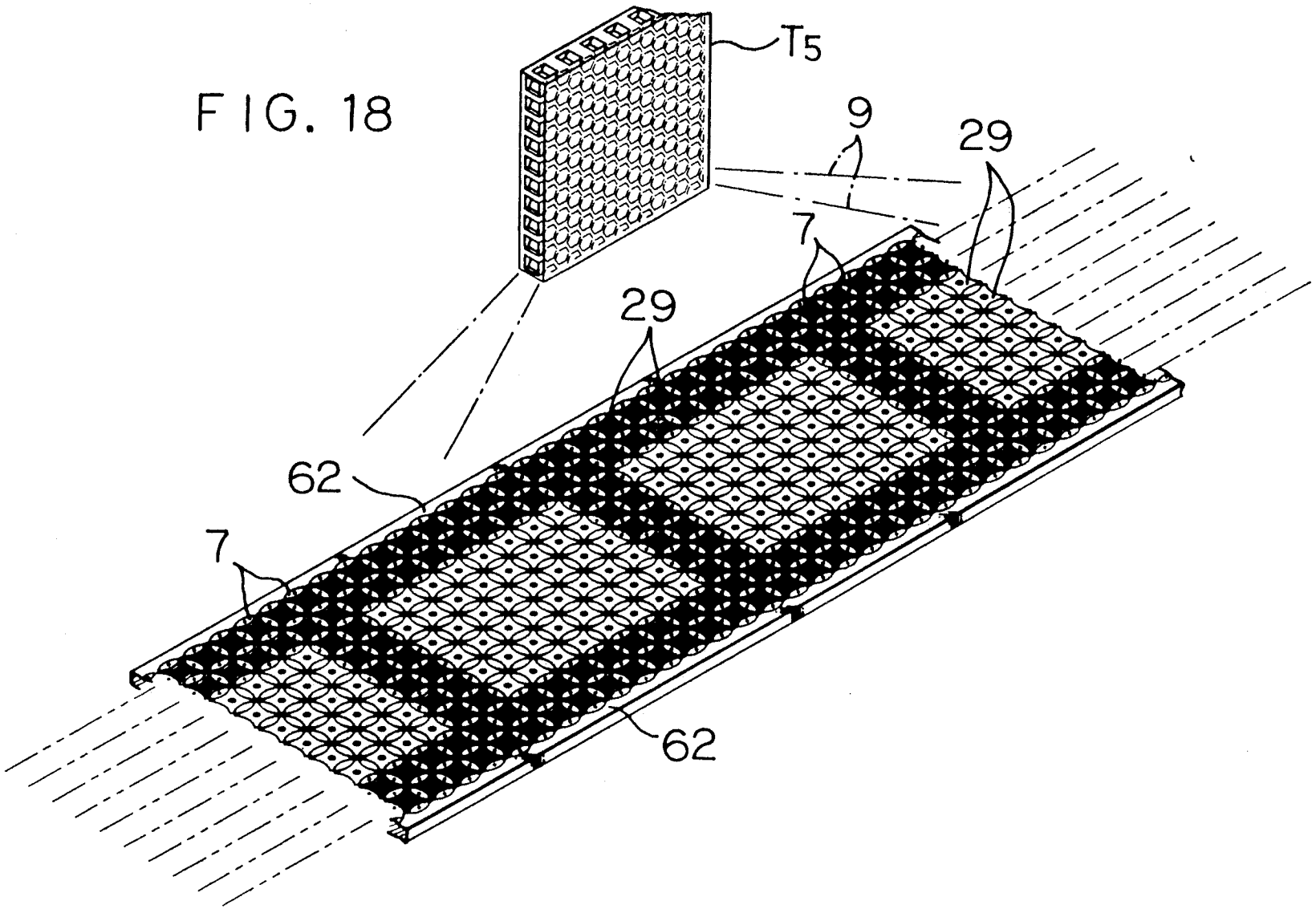
FIG. 18 is a perspective view showing a principal portion of still another apparatus for weaving three-dimensional fabrics of uneven cross-sections.

A weaving apparatus shown in FIG. 18 comprises, like the second weaving apparatus described before, a number of driving rotors 29 disposed in columns and rows across a single flat carrier traveling surface, with the rotors causing carriers 7 to move along predetermined paths. Unlike the second weaving apparatus, the carriers 7 are placed only between the rotors 29, 29 engaged in weaving and the rotors 29 and a stationary guide 62. Then, only the rotor holding the carriers 7 are driven to perform the desired weaving operation.

Figure 19A:
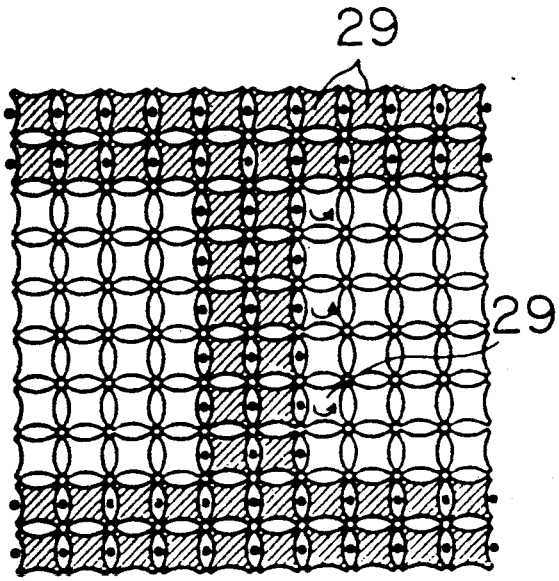
FIGS. 19A to 19D are partially enlarged views illustrating the weaving action of the apparatus shown in FIG. 18.
Figure 19B:
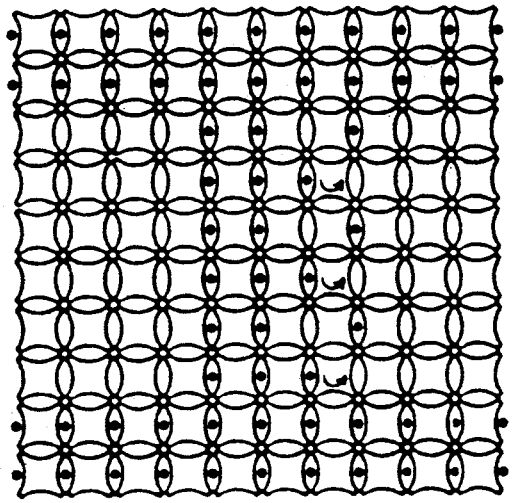
Figure 19C:
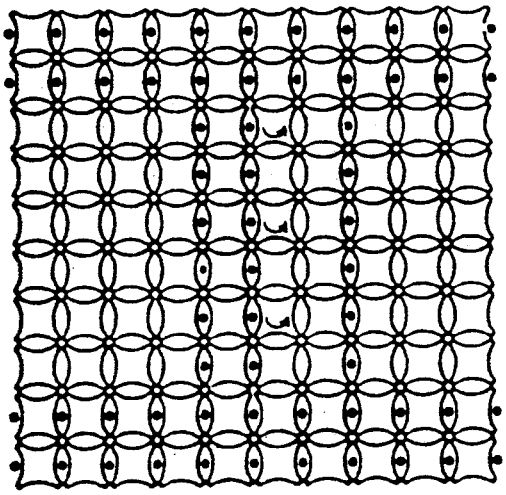
Figure 19D:
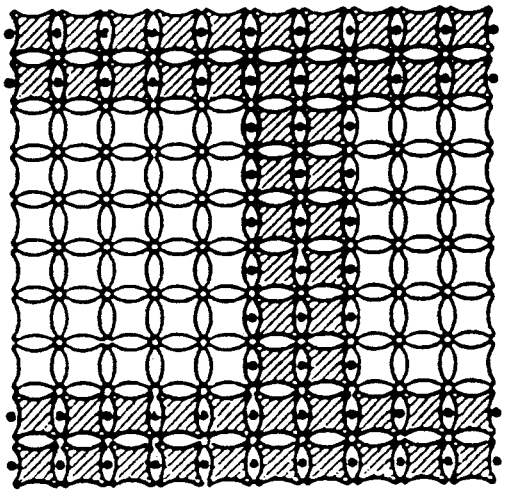

It is unnecessary to place the carriers 7 between all rotors 29 in the weaving area. Instead, the carriers 7 may be scattered according to the structure of the three-dimensional fabric to be woven (FIG. 19A).

In weaving the three-dimensional fabric $T_5$, only the hatched rotors in FIG. 18 are driven. The undriven rotors not engaged in weaving serve as a stationary guide of the driven carriers 7.

Here again, it is preferable to divide the rotors in the weaving area into two groups so that the rotors in one group are first turned 90 degrees or 180 degrees in one direction and, then, those in the other group through the same angle in the opposite direction.

Thus, a three-dimensional fabric is woven according to the arrangement of the driving rotors 29. The three-dimensional fabric $T_6$ with an uneven cross section can be produced by successively changing the cross-sectional shape of the fabric. This change can be achieved by successively controlling the motion of the driving rotors 29 and moving part of the carrier operating area from one place to another.

FIGS. 19A to 19D show a limited part of the weaving apparatus shown in FIG. 18 to illustrate the operation thereof. From FIG. 19A to FIG. 19C, the rotors 29 marked with arrows are successively turned in the direction of the arrows. By repeating the same cycle, the weaving area containing the hatched rotors in FIG. 19A moves to the hatched area in FIG. 19D. By repeating this cycle, the cross-sectional shape of a three-dimensional fabric can be varied. The resulting product has a honeycomb-like hollow structure like the three-dimensional fabric $T_6$ with an uneven cross section shown in FIG. 18.

Figure 20:
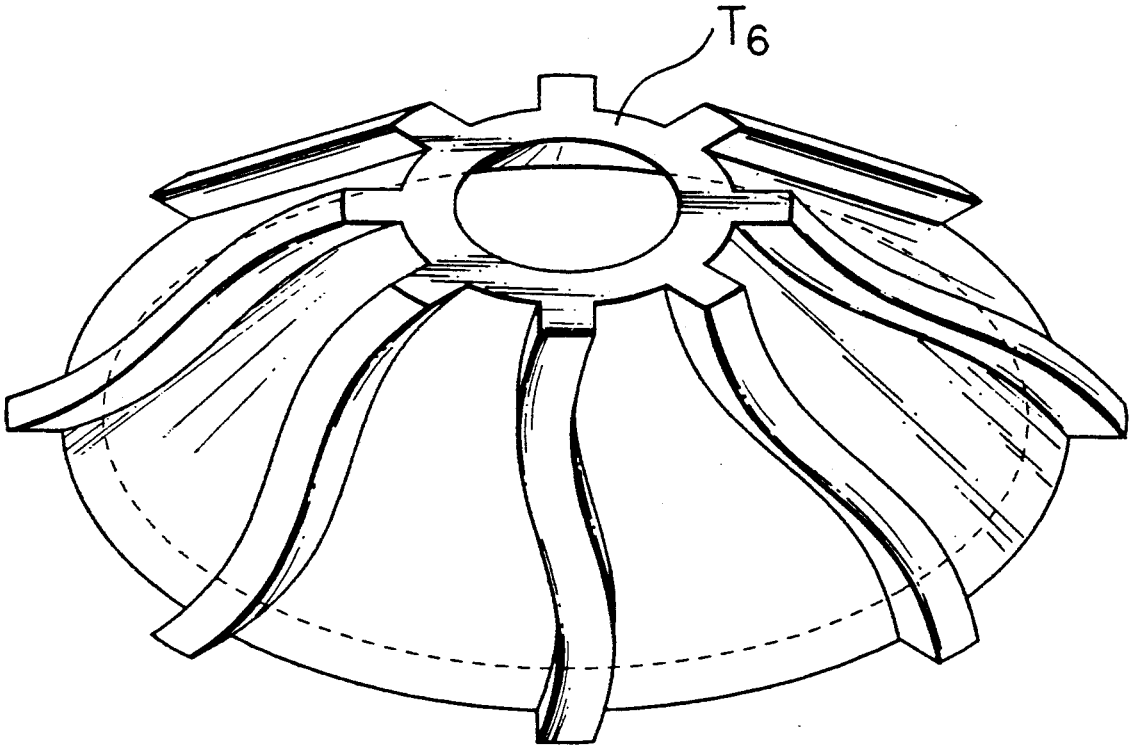
FIG. 20 is a perspective view of a three-dimensional fabric having curved ribs.

FIG. 20 shows a three-dimensional fabric $T_6$ with curved ribs that is produced by successively reciprocating, as indicated by arrow, a carrier moving area 64 projecting above the annual weaving area of the weaving apparatus shown in FIG. 13.

The three-dimensional fabric thus prepared have extensive use as reinforcements for parabolic antennas, helmets, nose cones, speaker cones, and various types of airplane parts and structural members for construction made of fiber-reinforced composite materials.

What is claimed is:

1. In a method of weaving a three-dimensional fabric by interlacing threads held by a large number of bobbin- or thread-carriers adapted to move about along predetermined paths of a traveling surface thereof, the improvement which comprises the steps of:

a) providing a large number of contiguous rotors that are adapted to be independently turned in two directions on said carrier traveling surface;

b) providing a plurality of recesses on each rotor so that a pair of adjoining rotors can hold one of the carriers therebetween;

c) shaping the recesses so that when one of the paired adjoining rotors rotate while holding the carrier the recesses on the other rotor serve as a guide to help a transfer of the carrier;

d) fitting a grip of the carrier formed of two cylindrical surfaces between the recesses of the rotors to hold the carrier therebetween;

e) moving the carrier by independently turning one of the paired rotors in increments of $\pm 90°$ holding the carrier to be moved;

f) causing a large number of carriers to move along the predetermined paths of said traveling surface by repeating a cycle of movement with a large number of rotors in predetermined sequence;

g) whereby the movement of the rotors and the movement of the carriers allow the threads held by the rotors and carriers to be woven into a three-dimensional fabric by crossing or engaging a thread contained by one of the rotors with that of the other rotors which are part of the large number of said contiguous rotors.

2. The improvement according to claim 1, further comprising:

the step of disposing a large number of said contiguous rotors having recesses on four sides thereof contiguous to one another in columns and rows;

dividing the rotors into two groups one of which consists of the rotors not continuous to one another in the columns and rows;

first turning the rotors in one group 90 degrees or 180 degrees in one direction while using the rotors in the other groups as idle stationary guides;

then using the rotors in the group first turned as idle stationary guides while turning the rotors in the other group 90 degrees or 180 degrees in the opposite direction of said rotors in said first group; and repeating this cycle until a three-dimensional fabric of the desired design is completed.

3. The improvement according to claim 1, which comprises the steps of joining together a plurality of weaving blocks each of which comprising a large number of said contiguous rotors having recesses on four sides thereof that are disposed contiguous to one another in columns and rows with the bordering rotors thereof placed next to one another, moving about carriers held between adjoining rotors in the individual blocks over an integrated weaving area covering the joined blocks, shifting the position of the adjoining weaving blocks relative to one another while continuing weaving, thereby changing the cross-sectional shape of the piece being woven to obtain a three-dimensional fabric of the desired uneven cross section.

4. The improvement according to claim 1, which comprises the steps of disposing a large number of said contiguous rotors having recesses on four sides thereof contiguous to one another in columns and rows, placing a large number of carriers between adjoining rotors, turning only necessary rotors to perform a weaving operation to make the desired shape, continuing weaving by successively turning different rotors, thereby changing the cross-sectional shape of the piece being woven to obtain a three-dimensional fabric of the desired uneven cross section.

5. The improvement according to claim 1, which comprises the steps of disposing a large number of said contiguous rotors having recesses on four sides thereof contiguous to one another in columns and rows, placing carriers between the rotors in an area employed for weaving, turning the rotors holding the carriers to perform a weaving operation to make the desired shape, continuing weaving by successively changing part of the carrier traveling area by controlling the motion of the rotors, thereby changing the cross-sectional shape of the piece being woven to obtain a three-dimensional fabric of the desired uneven cross section.

6. In an apparatus for weaving a three-dimensional fabric by interlacing threads held by a large number of bobbin- or thread-carriers adapted to move about along predetermined paths within a traveling surface thereof, the improvement which comprises a carrier driver that moves the carriers, said carrier driver comprising:

a) a large number of drive units for driving in two directions and disposed in a carrier traveling surface;

b) the drive units carrying rotors that are turned by said drive units in ±90° increments about their central axis in the carrier traveling surface, the rotors being disposed contiguous to one another in the carrier traveling surface;

c) each rotor having a plurality of recesses adapted to hold a carrier between a pair of adjoining rotors;

d) the carrier, having a grip, said grip being formed by two arched surfaces centered on the rotating axes of adjoining rotors to fit between the recesses thereof; and e) the recesses on the rotor being shaped so that when one of the paired adjoining rotors turns while holding the carrier the recesses on the other rotor serve as a guide to help a transfer of the carrier;

such that when one of the rotors holding the carrier turns to move the carrier, over the recesses on the other rotor serving as a transfer guide, the desired three-dimensional fabric is woven by way of a repetition of this cycle with many rotors.

7. The improvement according to claim 6, in which the carrier held between the recesses on the rotors holds a bobbin holding a thread wound therearound.

8. The improvement according to claim 6, in which the carrier traveling surface in which a large number of contiguous rotors are disposed consists of a spherical closed surface truncated at the top and bottom thereof.

9. The improvement according to claim 8, in which the recesses on the rotor and the grip on the carrier corresponding thereto are shaped into a cone whose surface converges to the center of the spherical carrier traveling surface.

10. The improvement according to claim 6, in which the carrier traveling surface in which a large number of contiguous rotors are disposed consists of a spherical or cylindrical closed surface truncated at the top and bottom thereof, with a weaving point setter that provides a weaving point for a three-dimensional fabric by collecting the threads from the carriers provided within the carrier traveling surface.

* * * * *